US006033237A

United States Patent [19]

Sai et al.

[11] Patent Number: 6,033,237

[45] Date of Patent: Mar. 7, 2000

[54] ELECTRICAL CONNECTOR ASSEMBLY AND METHOD FOR MANUFACTURING THE SAME

[75] Inventors: Noriaki Sai; Toshiaki Kohno, both of Kanagawa, Japan

[73] Assignee: The Whitaker Corporation, Wilmington, Del.

[21] Appl. No.: 09/056,807

[22] Filed: Apr. 8, 1998

[30] Foreign Application Priority Data

Apr. 25, 1997 [JP] Japan ..... 9-123261
Nov. 7, 1997 [JP] Japan ..... 9-202481

[51] Int. Cl.[7] ..... H01R 9/09; H01R 1/00

[52] U.S. Cl. ..... 439/76.2; 439/736

[58] Field of Search ..... 439/762, 76, 736; 29/848, 883; 264/272.11; 361/813

[56] References Cited

U.S. PATENT DOCUMENTS

| | | | |
|---|---|---|---|
| 4,405,192 | 9/1983 | Eaby et al. | 339/91 R |
| 4,959,018 | 9/1990 | Yamamoto et al. | 439/76 |
| 5,040,097 | 8/1991 | Stribel | 361/395 |
| 5,067,905 | 11/1991 | Matsumoto et al. | 439/76 |
| 5,207,587 | 5/1993 | Hamill et al. | 436/76 |
| 5,703,754 | 12/1997 | Hinze | 361/736 |
| 5,749,739 | 5/1998 | Saka et al. | 439/76.2 |
| 5,764,487 | 6/1998 | Natsume | 361/775 |
| 5,872,333 | 2/1999 | Uezono et al. | 174/55 |

OTHER PUBLICATIONS

Japanese Patent Publication No. 6–16423 (JP–B–6–16423) Filed by Fujitsu Ltd.—Apr. 23, 1987 and Published—Mar. 2, 1994. Entitled—"Connector".

*Primary Examiner*—Renee S. Luebke
*Assistant Examiner*—Chandrika Prasad

[57] ABSTRACT

The present invention provides a waterproof electrical connector assembly which is molded in two separate processes. Pluralities of respective projections 42, 48 protrude from surfaces 45, 46 of an inner housing 44 which has contacts 20, 30 so that a contact assembly 40 is formed. Contact assembly 40 is placed in a mold and positioned so that the tip ends of the projections 42, 48 substantially engage inside surfaces of the mold; afterward, an outer housing is molded to a thickness which is substantially the same as the height of the projections 42, 48.

14 Claims, 6 Drawing Sheets

40
42
42
20a
20
20b
30
44
30a
42
30b
V

ELECTRICAL CONNECTOR ASSEMBLY AND METHOD FOR MANUFACTURING THE SAME

FIELD OF THE INVENTION

The present invention relates to an electrical connector assembly, and more specifically relates to an electrical connector assembly in which the housing is molded in two separate processes.

BACKGROUND OF THE INVENTION

In cases where connectors are molded, the molding is sometimes performed in two separate processes. For example, FIG. 8 shows a connector 100 disclosed in Japanese Patent Application No. 6-16423. Connector 100 has electrical contacts 104 press-fitted in a housing 102 formed by primary molding, and a housing 106 is further formed by secondary molding. Before the housing 106 is molded, it is necessary to place the housing 102 which has the contacts 104 in a prescribed position inside the mold.

Accordingly, the horizontal portions 108 of the contacts 104 are held by means of ejector pins (not shown) in the mold during injection molding, so that deformation is prevented. The reason that the contacts are held by ejector pins is that the contacts tend not to be affected by high temperatures during molding.

When the contacts are pressed by ejector pins, holes which lead from the outer surface of the housing to the contacts remain in the molded product following molding. If water or moisture is present, the water enters the connector via these holes and reaches the interior of the connector by passing through the gaps between the contacts and the housing. Accordingly, such connectors cannot be made waterproof.

The present invention was devised in light of the above points. One object of the present invention is to provide a waterproof electrical connector assembly in which no holes formed by ejector pins remain in the outer surface through which water can flow.

Another object of the present invention is to provide a low-cost electrical connector assembly which makes it possible to achieve a further simplification of the mold used for molding the connector.

SUMMARY OF THE INVENTION

An electrical connector assembly of the present invention comprises a contact assembly in which a plurality of projections are disposed along a surface of an inner housing which has electrical contacts, and an outer housing on which female housings that surround some of the contacts of the contact assembly are molded, and which has an overmolding molded to a thickness that is substantially the same as the height of the projections on a surface outside the female housings.

Furthermore, the electrical connector assembly of the present invention has circuit conductors constituting electrical wiring supported by an integral molding of a resin, pin removal holes formed as a result of the circuit conductors being supported by ejector pins during molding are left only in an inside of a waterproof case, and are blocked by means of the over-molding of additional resin in the intermediate wiring areas between the waterproof case and the female connector housings.

Furthermore, the method of the present invention for manufacturing an electrical connector assembly includes installing a contact lead frame in an inner housing and a plurality of projections are integrally molded along a surface of the inner housing so that a contact assembly is formed, and placing the contact assembly in a mold so that the tip ends of the projections are substantially in engagement with an inside surface of the mold, and molding an outer housing on a surface of the inner housing.

An electrical connector assembly comprises a contact assembly having a series of electrical contacts and projections secured in an inner housing with the electrical contacts and projections protruding outwardly from a surface of the inner housing; and an outer housing secured onto the inner housing with the electrical contacts extending outwardly from an outer surface of the outer housing and the projections sealingly secured within the outer housing.

BRIEF DESCRIPTION OF THE DRAWINGS

Embodiments of the present invention will now be described by way of example with reference to the accompanying drawings in which.

DETAILED DESCRIPTION OF THE INVENTION

Figure 1:
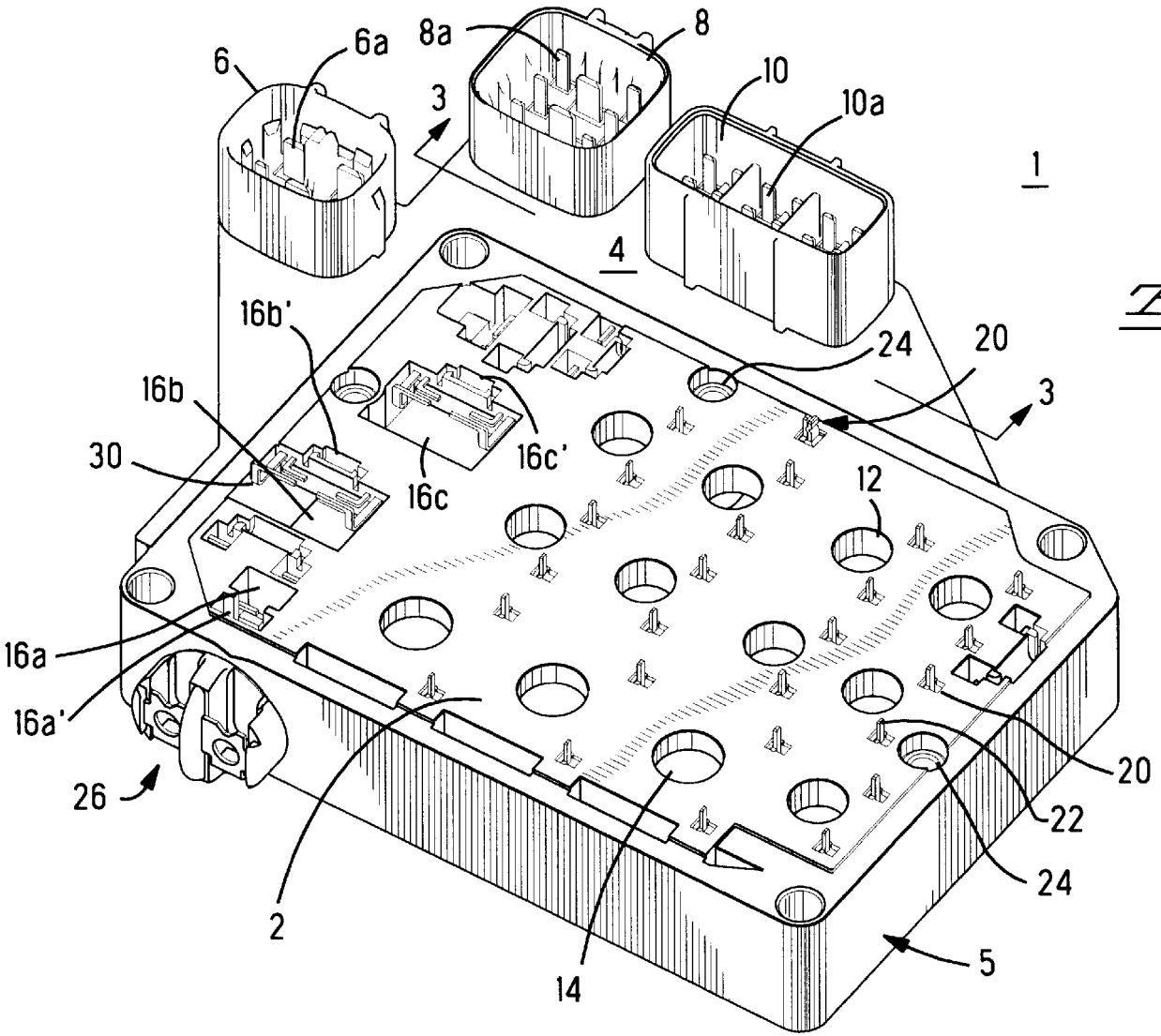
FIG. 1 is a perspective view of an electrical connector assembly of the present invention as seen from above.

FIG. 1 is a perspective view of an electrical connector assembly 1 of the present invention which is used for ABS control in an automobile. In connector assembly 1, an external view of the housing 5 as a secondarily molded outer housing part is shown. Housing 5 has a substantially rectangular first surface 2 on which electronic components (not shown) are installed, an extension 4, which forms an integral continuation of first surface 2, and female connector housings 6, 8, 10 are disposed on extension 4. A plurality of circular holes 12, 14 are formed in the first surface 2, and tip end portions 22 of electrical contacts 20 protrude outwardly from surface 2 adjacent holes 12, 14. Solenoids (not shown) used for ABS control are installed in the holes 12, 14, and the respective solenoids are electrically connected to the tip end portions 22 of the contacts 20.

Furthermore, rectangular openings 16*a*, 16*b*, 16*c* are formed in the first surface 2, and electronic components (not shown) are installed in recesses 16*a*', 16*b*', 16*c*' . . . located adjacent openings 16*a*, 16*b*, 16*c* . . . The tip ends of other electrical contacts 30 protrude into the respective openings 16*a*, 16*b*, 16*c* . . . , and are electrically connected to the electronic components. Afterward, a cover (not shown) is attached, and the connector assembly is attached to a vehicle body by means of bolts (not shown) via holes 24. Moreover, the cover is tightly attached to the housing 5. Furthermore, a power supply connector is located along a side of housing 5. The contacts 6*a,* 8*a,* 10*a,* which are located in female connector housings 6, 8, 10 form integral continuations of the solenoid contacts 20 or contacts 30. Mating plug connectors (not shown) are electrically matable with the female connector housings 6, 8, 10.

Figure 2:
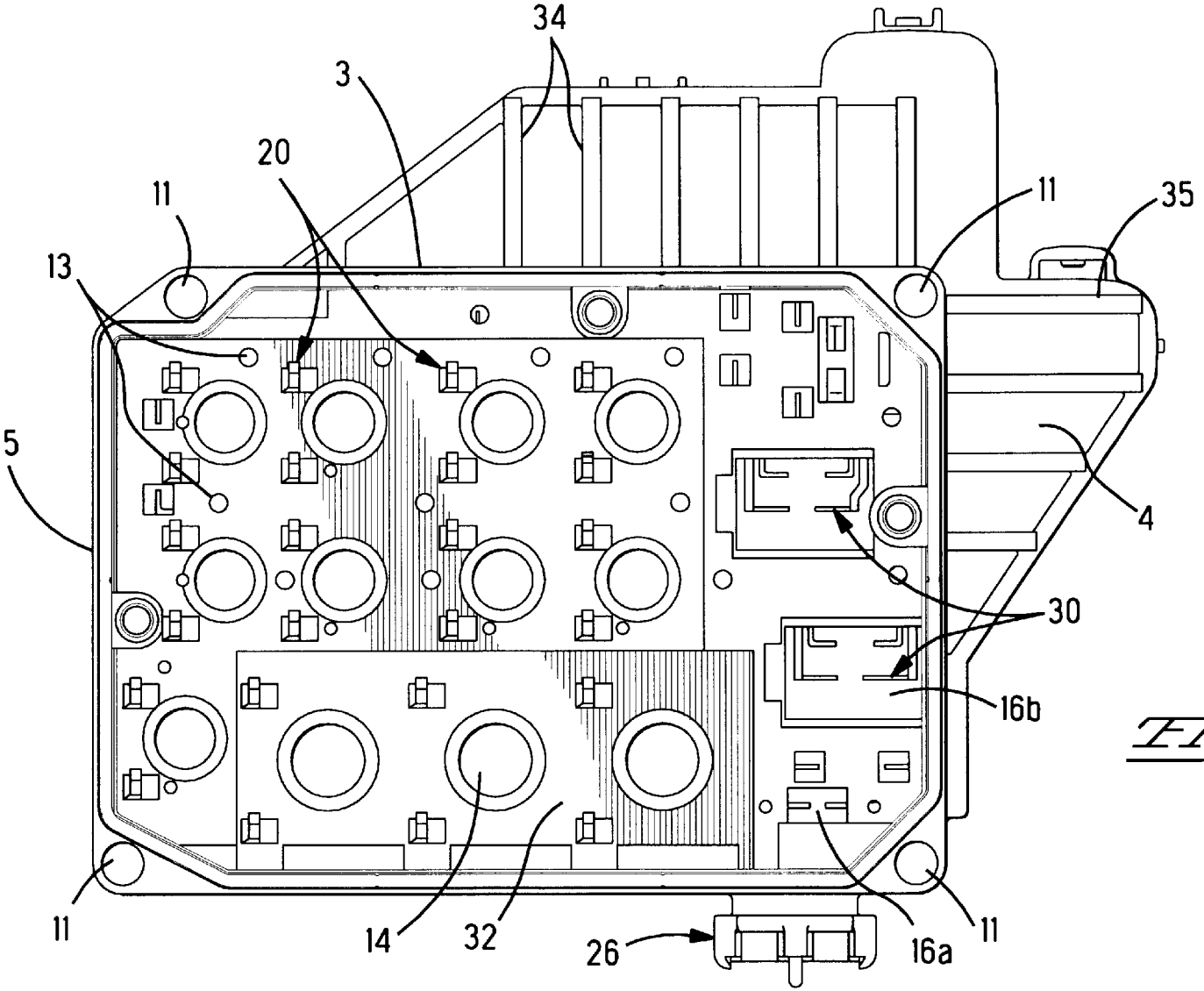
FIG. 2 is a bottom view of the electrical connector assembly shown in FIG. 1.

FIG. 2 is a bottom view of the connector 1 shown in FIG. 1. A substantially rectangular second surface 32 is also formed on the bottom surface of the connector 1 which is on the opposite side from the first surface 2, and the holes 12, 14 and contacts 20, 30 described above are exposed to view at second surface 32. Like the first surface 2, the second surface 32 is also covered by means of a cover (not shown). Holes 11 formed in four places are used for attachment of the cover. A plurality of ribs 34, 35 used for reinforcement protrude from the substantially rectangular main body and are formed on the bottom of extension 4. Small holes 13 (pin removal holes) are formed in the areas surrounding the contacts; these are used to support the contacts 20, 30 by means of ejector pins during molding. In other words, ejector pins are used in the region that is made waterproof by means of covers.

Figure 3:
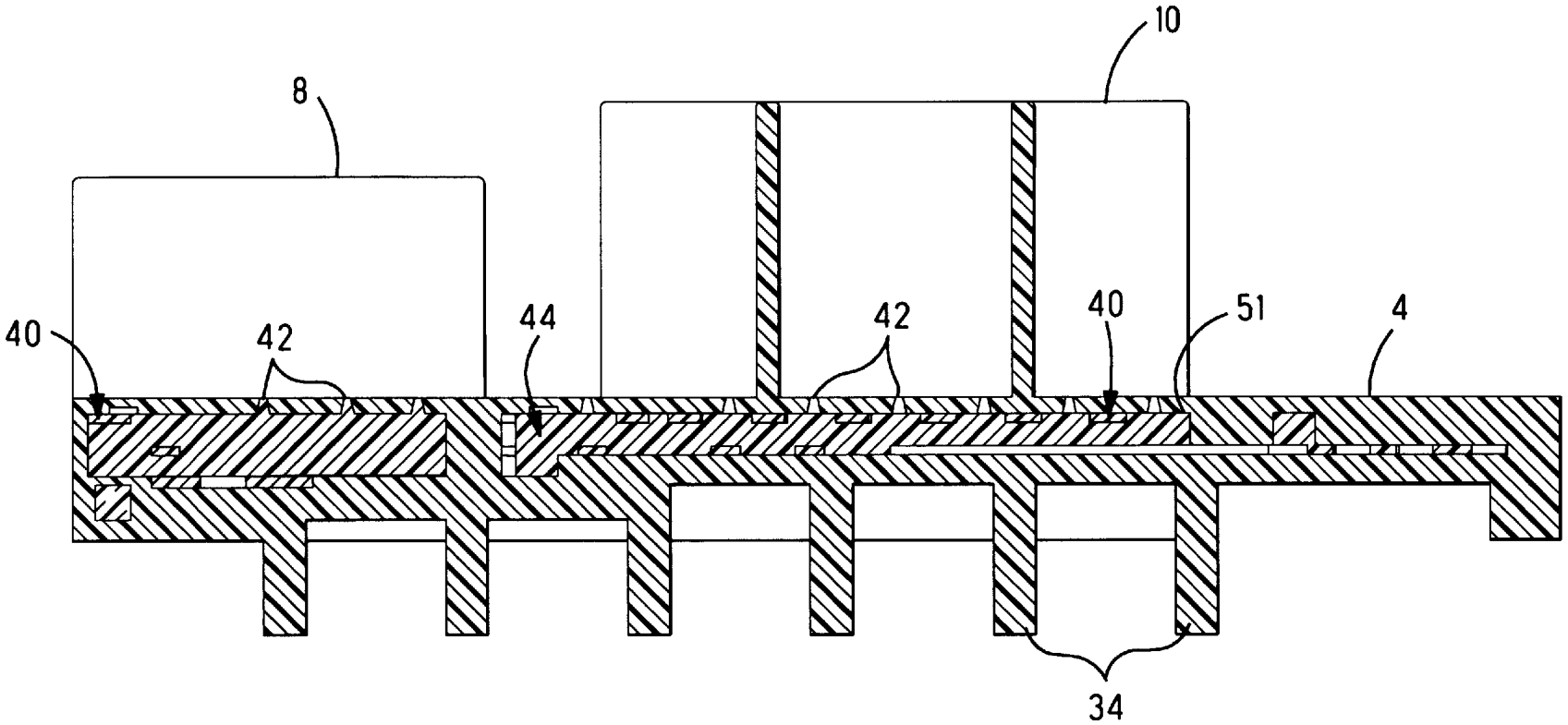
FIG. 3 is an enlarged cross-sectional view taken along line 3—3 in FIG. 1.
Figure 4:
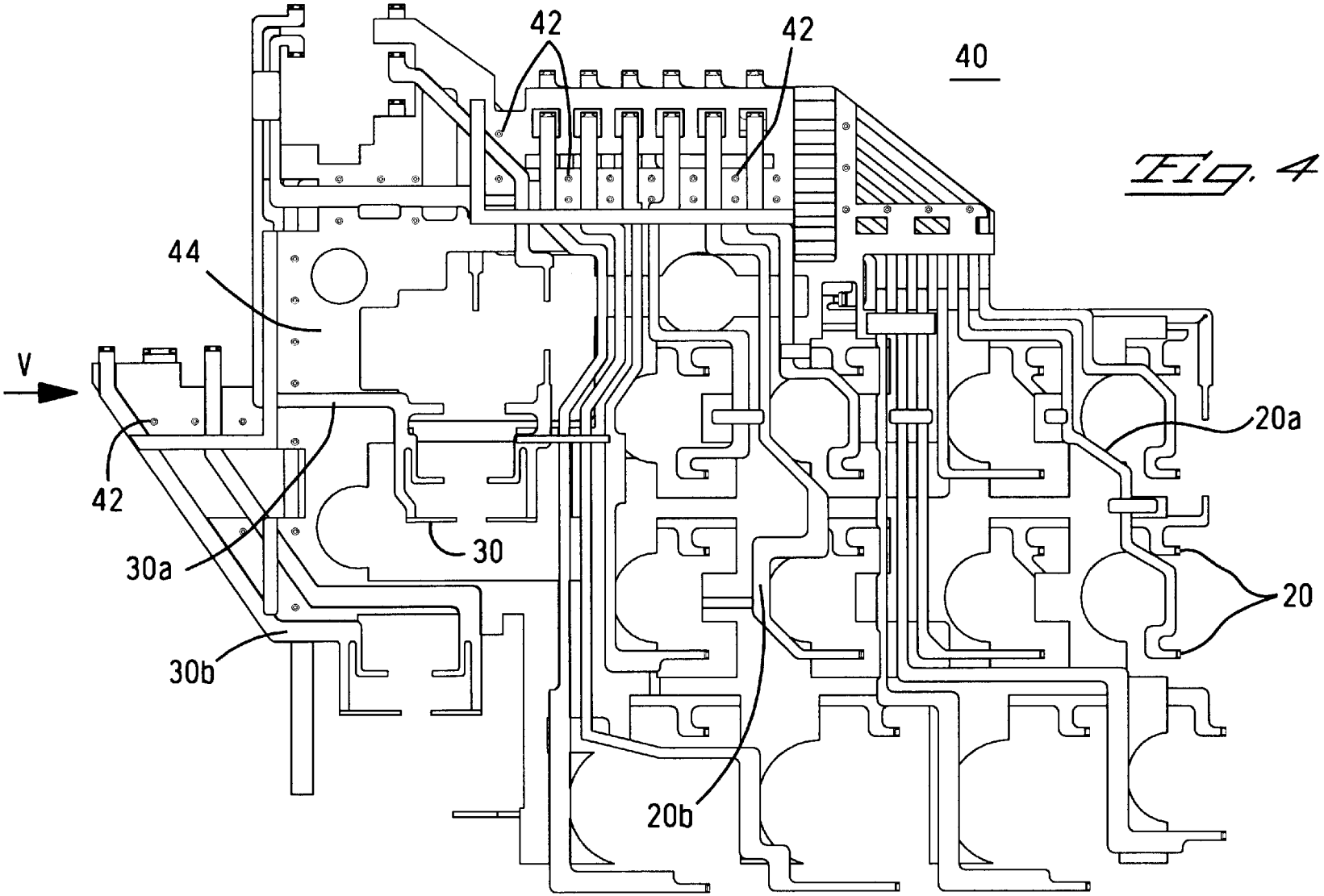
FIG. 4 is a plan view of a contact lead frame.
Figure 5:
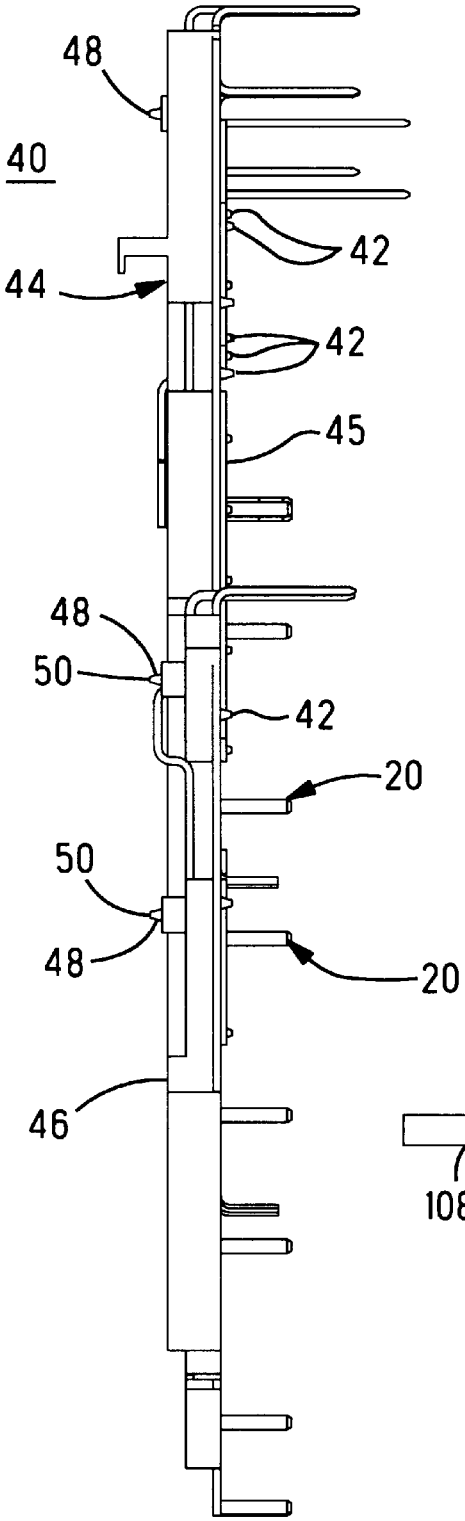
FIG. 5 is a side view of the contact lead frame shown in FIG. 4, as seen from the direction indicated by arrow V.
Figure 8:
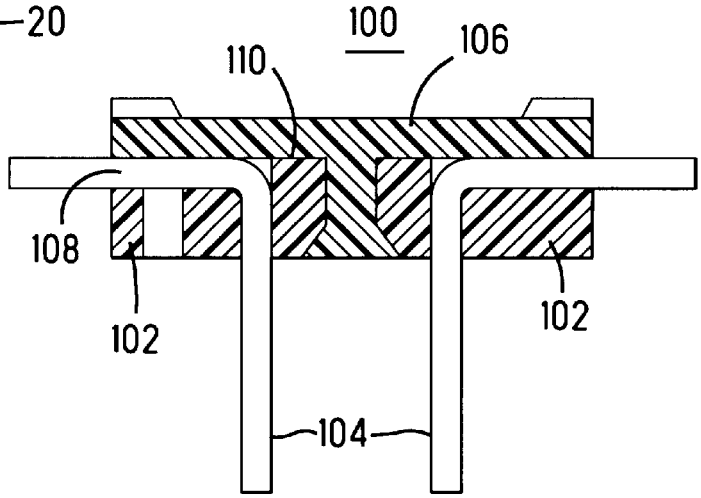
Fig. 8 Prior Art
FIG. 8 is a cross-sectional view which illustrates a conventional electrical connector assembly.

FIG. 3 is an enlarged cross-sectional view along line 3—3 in FIG. 1. The inside of the extension 4 is molded on top of contact assembly 40. The contact assembly 40 shown in FIG. 4 is assembled by insert-molding the contacts 20, 30 in a dielectric inner housing 44. A plurality of contacts are disposed on both surfaces of the contact assembly 40. Furthermore, a plurality of projections 42 protrude as integral parts from upper surface 45 of the contact assembly 40 (FIG. 5). The tip ends of these projections engage an inside surface of the mold when the extension 4 is molded; in this way, the contact assembly 40 is properly positioned. For example, the projections 42 are formed in the shape of truncated cones with a diameter of 1 mm at the base and a diameter of 0.5 mm at the top. The inner housing 44 of the contact assembly 40 is formed from for example a polybutylene terephthalate (PBT) known as Duranex 301RA.

It is desirable that the tip ends of the respective projections 42 of the contact assembly 40 melt and mix with the resin material of the extension 4 during the molding of the extension 4. Gaps between the projections 42 and the resin material are eliminated so that penetration of water from the outside can be prevented. In FIG. 3, the projections 42 are seen only on one surface; in actuality, however, the projections 42 can also protrude in different positions on the opposite surface 46, which do not appear in FIG. 3. This will be described later. The projections 42 have a truncated conical shape; this shape is used in order to facilitate melting of the small-volume tip ends of the projections by the heat generated during secondary molding, i. e., during the molding of the outer housing. This partial melting occurs in spot form on the outer surface of the extension 4 after molding.

Next, FIG. 4 shows a plan view of the contact assembly 40 in the form of a lead frame. This plan view corresponds to the plan view of the connector 1 shown in FIG. 1. It is seen that numerous projections 42 are formed on portions other than the waterproofed first surface 2, i. e., on portions of the inner housing 44 corresponding to the extension 4. Furthermore, the formation of traces as circuit conductors 20*a,* 20*b*, . . . 30*a,* 30*b* . . . which form intermediate wiring parts between the female connector housings 6, 8, 10 and the contacts 20, 30 may also be seen. These traces are disposed on the inner housing 44 in approximately three layers. There are numerous traces; however, reference numbers are shown for only some of the traces, and are omitted for the rest.

FIG. 5 is a side view of the contact assembly 40 shown in FIG. 4, as seen from the direction indicated by arrow V. The formation of projections 48 in three places on the opposite surface 46 from the projections 42 is clearly shown. The tip ends 50 of the projections 48 also engage an inside surface of the mold (not shown), so that projections 48 have the same effect as the projections 42. For example, the projections 48 are formed as cylindrical columns with a diameter of approximately 3 mm. The reason that the number of projections differs between the surface 45 and the surface 46 is as follows: i. e., in the present embodiment, the force acting in a rightward direction with respect to FIG. 5 is larger as a result of the influx of injected resin; accordingly, more projections 42 are disposed on the surface 45 in order to receive this force.

Figure 6:
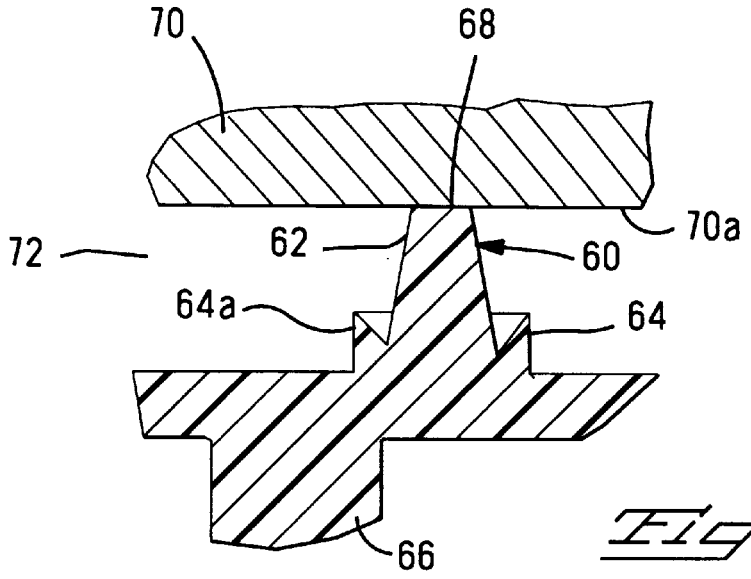
FIG. 6 is a part cross-sectional view showing an embodiment of the shape of a projection.
Figure 7:
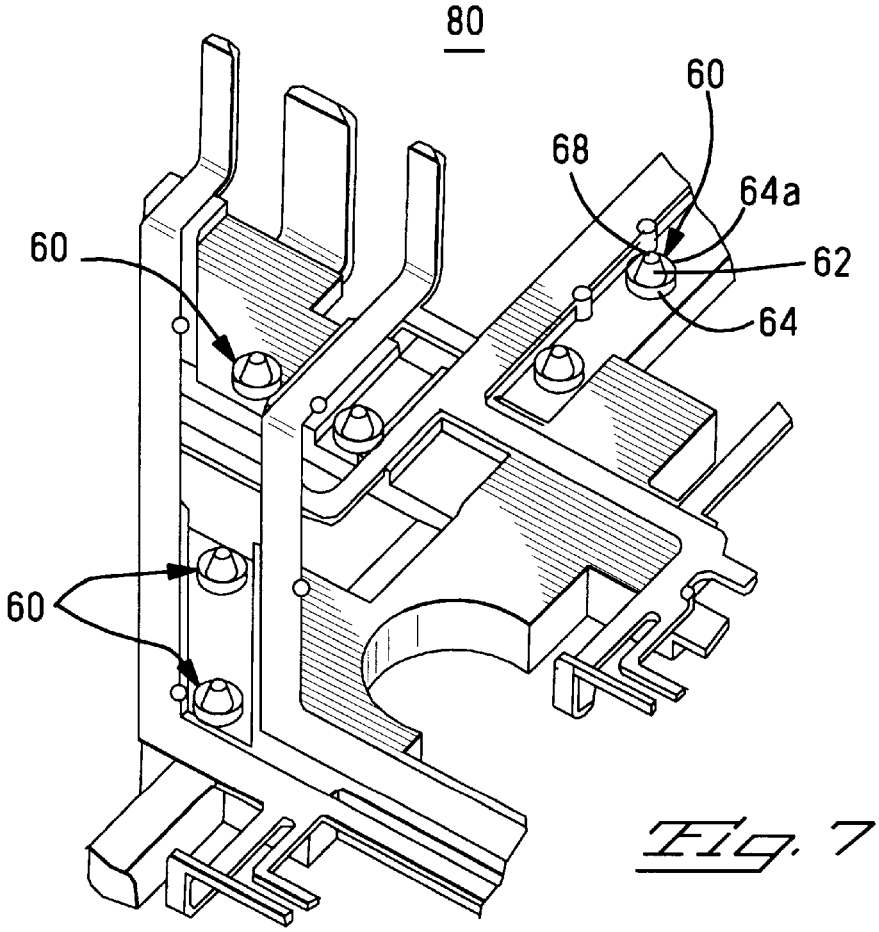
FIG. 7 is a part perspective view of the contact lead frame containing the projection of FIG. 6.

An alternative embodiment of the projection is shown in FIGS. 6, 7. Each of projections 60 has a main body 62 with a truncated conical shape, which rises from inner housing 66, and an annular section 64, which surrounds main body 62 at a point where the main body rises. The annular section 64 narrows toward the tip end so that this tip end forms an annular edge 64*a*. Inside mold 70, the flat tip ends 68 of projections 60 engage an inside surface 70*a* of the mold 70, and the resin forming the outer housing is injected during secondary molding thereby filling the space 72 between the inner housing 66 and the inside surface 70*a* of the mold 70. In this case, the edges 64*a* of the annual sections 64, which have a small volume, are melted by the high-temperature resin of the secondary molding, and are integrated with the filling resin forming the outer housing.

The shape of the projections 60 is especially effective in areas widely separated from the gate (not shown) through which the resin filling the space 72 is injected during secondary molding. As the distance from the gate increases, the temperature of the portions of the melted resin that engage the mold 70 drops, so that the tip ends 68 of the projections 60 are less likely to melt. However, the temperature does not show such a great drop in the interior portions of the filling resin; accordingly, the edges 64*a* which have a small volume can be melted. These projections 60 are formed on the surface of the contact assembly 80 as indicated as shown in FIG. 7.

Embodiments of the present invention have been described above. However, it goes without saying that various modifications are possible. The projections may also have the shape of square pyramids or square columns.

The electrical connector assembly of the present invention is equipped with a contact assembly in which a plurality of projections are disposed along a surface of an inner housing which has electrical contacts, and an outer housing which is molded to a thickness that is substantially the same as the height of the projections on the surface other than the engaging parts of the contact assembly. Accordingly, the electrical connector assembly possesses the following merit:

Specifically, since the area between the inner housing and the outer housing is securely waterproofed, the penetration of water into the interior of the connector assembly is prevented, so that no loss of electrical performance occurs.

Furthermore, in the electrical connector assembly of the present invention, pin removal holes are left only in the area inside the waterproof case at the time of molding. In the intermediate wiring parts between the engaging parts and the waterproof case, the pin removal holes are blocked by over-molding of additional resin. Accordingly, the following merit is obtained:

Specifically, even in cases where the intermediate wiring parts are long, an electrical connector assembly with a waterproof function can be obtained, since no pin removal holes are formed in the intermediate wiring parts.

Furthermore, the method of the present invention for manufacturing an electrical connector assembly includes a process in which contacts are installed in an inner housing and a plurality of projections are integrally molded along a surface of the inner housing so that a contact assembly is formed, and the contact assembly is placed in a mold so that the projections substantially engage an inside surface of the mold, and an outer housing is molded on the surface of the mold. Accordingly, the following merit is obtained:

Specifically, since the need for ejector pins is eliminated, the structure of the mold can be simplified. Accordingly, a low-cost waterproof electrical connector assembly can be obtained.

We claim:

1. An electrical connector assembly, comprising:

a contact assembly having a series of electrical members secured in an inner housing; electrical contacts protruding outwardly from a surface of the inner housing and projections molded on the inner housing; and an outer secondarily molded housing molded onto the inner housing with the electrical contacts extending outwardly from an outer surface of the outer secondarily molded housing and the projections sealingly molded within the secondarily molded outer housing.

2. An electrical connector assembly as claimed in claim 1, wherein said inner and outer housings have an extension in which said projections are secured.

3. An electrical connector assembly as claimed in claim 2, wherein female housings are located on the extension with some of the electrical contacts disposed therein.

4. An electrical connector assembly as claimed in claim 2, wherein ribs extend from the inner housing and along the extension for reinforcement.

5. An electrical connector assembly as claimed in claim 1, wherein said projections are truncated cones.

6. An electrical connector assembly as claimed in claim 5, wherein an annular section surrounds each of the truncated cones.

7. An electrical connector assembly as claimed in claim 6, wherein the annular section narrows toward a tip end forming an annular edge.

8. An electrical connector assembly as claimed in claim 1, wherein the thickness of the outer housing is substantially the height of the projections.

9. A method of manufacturing an electrical connector assembly, comprising the steps of:

molding a contact lead frame within an inner housing of dielectric material with a series of electrical contacts extending outwardly from a surface of the inner housing and with molded projections extending outwardly from the same surface of the inner housing; thereby forming a contact assembly; and molding a secondarily molded outer housing onto the inner housing with the electrical contacts extending outwardly form an outer surface of the secondarily molded outer housing and with the projections sealingly molded within the secondarily molded outer housing.

10. A method of manufacturing an electrical connector assembly as claimed in claim 9, wherein an extension is formed with reinforcement ribs during the molding of the inner and outer housings.

11. A method of manufacturing an electrical connector assembly as claimed in claim 10, wherein the projections are located on said inner housing where the extension is located.

12. A method of manufacturing an electrical connector assembly as claimed in claim 10, wherein female housings are formed as part of said extension.

13. A method of manufacturing an electrical connector assembly as claimed in claim 9, wherein said projections are truncated cones.

14. A method of manufacturing an electrical connector assembly as claimed in claim 13, wherein annular sections are located around the bases of the truncated cones.

* * * * *